US009181959B2

(12) United States Patent
Rosen et al.

(10) Patent No.: US 9,181,959 B2
(45) Date of Patent: Nov. 10, 2015

(54) MOTOR HOUSING

(75) Inventors: Seth E. Rosen, Middletown, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 636 days.

(21) Appl. No.: 13/568,860

(22) Filed: Aug. 7, 2012

(65) Prior Publication Data

US 2014/0044531 A1 Feb. 13, 2014

(51) Int. Cl.
*F04D 29/10* (2006.01)
*F04D 29/40* (2006.01)
*F04D 29/42* (2006.01)

(52) U.S. Cl.
CPC ..... *F04D 29/422* (2013.01)

(58) Field of Classification Search
CPC ..... F04D 17/10; F04D 25/0606; F04D 29/10; F04D 29/42; F04D 29/601
See application file for complete search history.

(56) References Cited

U.S. PATENT DOCUMENTS 4,021,215 A 5/1977 Rosenbush et al.
4,451,046 A * 5/1984 Bliven ..... 277/419
5,146,797 A 9/1992 Annovazzi et al.
5,299,763 A 4/1994 Bescoby et al.
5,310,311 A 5/1994 Andres et al.
5,353,657 A 10/1994 Bainbridge, III
5,784,894 A 7/1998 Army, Jr. et al.
6,257,003 B1 7/2001 Hipsky
6,427,471 B1 8/2002 Ando et al.
7,779,644 B2 8/2010 Decrisantis et al.
8,529,192 B2 * 9/2013 Beers et al. ..... 415/107
2004/0261428 A1 12/2004 Murry et al.
2006/0067833 A1 * 3/2006 McAuliffe et al. ..... 417/43
2006/0080832 A1 4/2006 Yip et al.
2012/0011878 A1 * 1/2012 Hipsky ..... 62/401
2012/0064814 A1 * 3/2012 Beers et al. ..... 454/71
2012/0064815 A1 * 3/2012 Beers et al. ..... 454/71
2012/0114465 A1 * 5/2012 Beers et al. ..... 415/165
2014/0026993 A1 * 1/2014 Rosen et al. ..... 137/565.01
2014/0030070 A1 * 1/2014 Beers et al. ..... 415/170.1

* cited by examiner

*Primary Examiner* — Igor Kershteyn

(74) *Attorney, Agent, or Firm* — Carlson, Gaskey & Olds, P.C.

(57) ABSTRACT

An example housing of a cabin air compressor assembly includes a main body portion and a motor outlet duct extending radially from the main body portion. The motor outlet duct interfaces with the main body portion at an interface area. A ratio of a radius of the interface area to an inner diameter of the motor outlet duct is from 0.113 to 0.162.

20 Claims, 8 Drawing Sheets

MOTOR HOUSING

BACKGROUND

This disclosure relates to a compressor for use in supplying cabin air in an aircraft and, more particularly, to a housing for such a compressor.

Compressors that supply cabin air are known. Compressors typically include a motor driven to rotate a shaft and in turn drive a compressor rotor. The rotor moves a first supply of air into the compressor. This air is cooled and delivered to the cabin.

At least the motor is held within a housing. A second supply of air moves through the housing from an inlet to an outlet of the compressor. The air moves through the motor to cool the motor.

SUMMARY

An example housing of a cabin air compressor assembly includes a main body portion and a motor outlet duct extending radially from the main body portion. The motor outlet duct interfaces with the main body portion at an interface area. A ratio of a radius of the interface area to an inner diameter of the motor outlet duct is from 0.113 to 0.162.

Another example housing of a cabin air compressor assembly includes a housing, and at least one tie rod mounting flange providing an aperture configured to receive a tie rod. A centerpoint of the aperture is located a first distance from an end of the housing and a second distance from a central axis of the housing. A ratio of the first distance to the second distance is from 1.65 to 3.07.

Yet another example housing of a cabin air compressor assembly includes a seal land provided within a compressor housing, an inwardly facing surface of the seal land spaced a first distance from a rotational axis of the compressor, and a seal that is received within the seal land. An inwardly facing surface of the seal land is spaced a second distance from the rotational axis of the compressor. A ratio of the first distance to the second distance is from 1.139 to 1.145.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
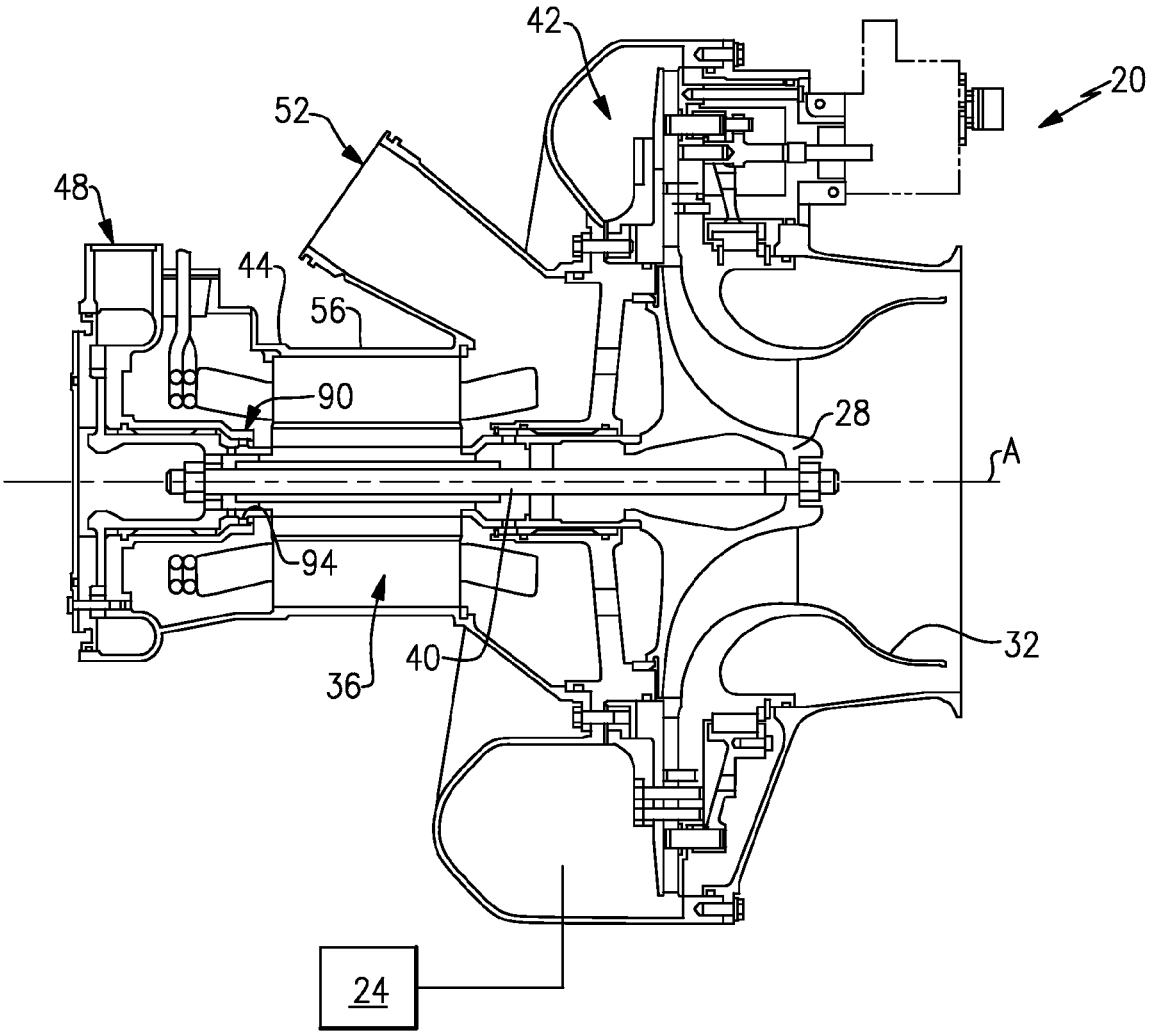
FIG. 1 shows a cross-sectional view of an example cabin air compressor assembly.

Referring to FIG. 1, an example cabin air compressor assembly 20 is incorporated into a cabin air supply system 24 of an aircraft. The cabin air compressor assembly 20 is used to condition air for use within the cabin.

The cabin air compressor assembly 20 includes a rotor 28 that receives air to be compressed through a compressor inlet shroud 32. A motor 36 rotates a driveshaft 40 to rotate the rotor 28. The rotor 28 receives the air from the compressor inlet shroud 32 and passes it to a compressor outlet 42.

Figure 2:
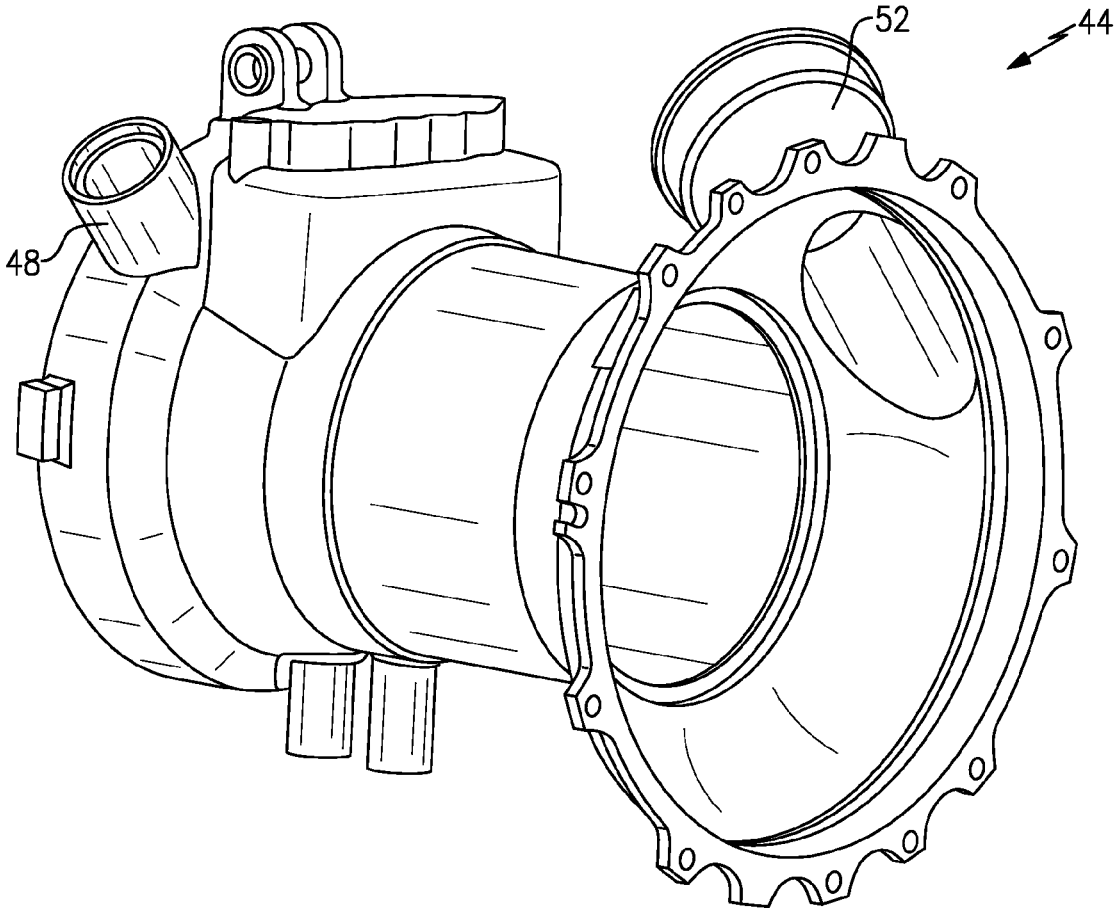
FIG. 2 shows a perspective view of a housing from the FIG. 1 assembly.
Figure 3:
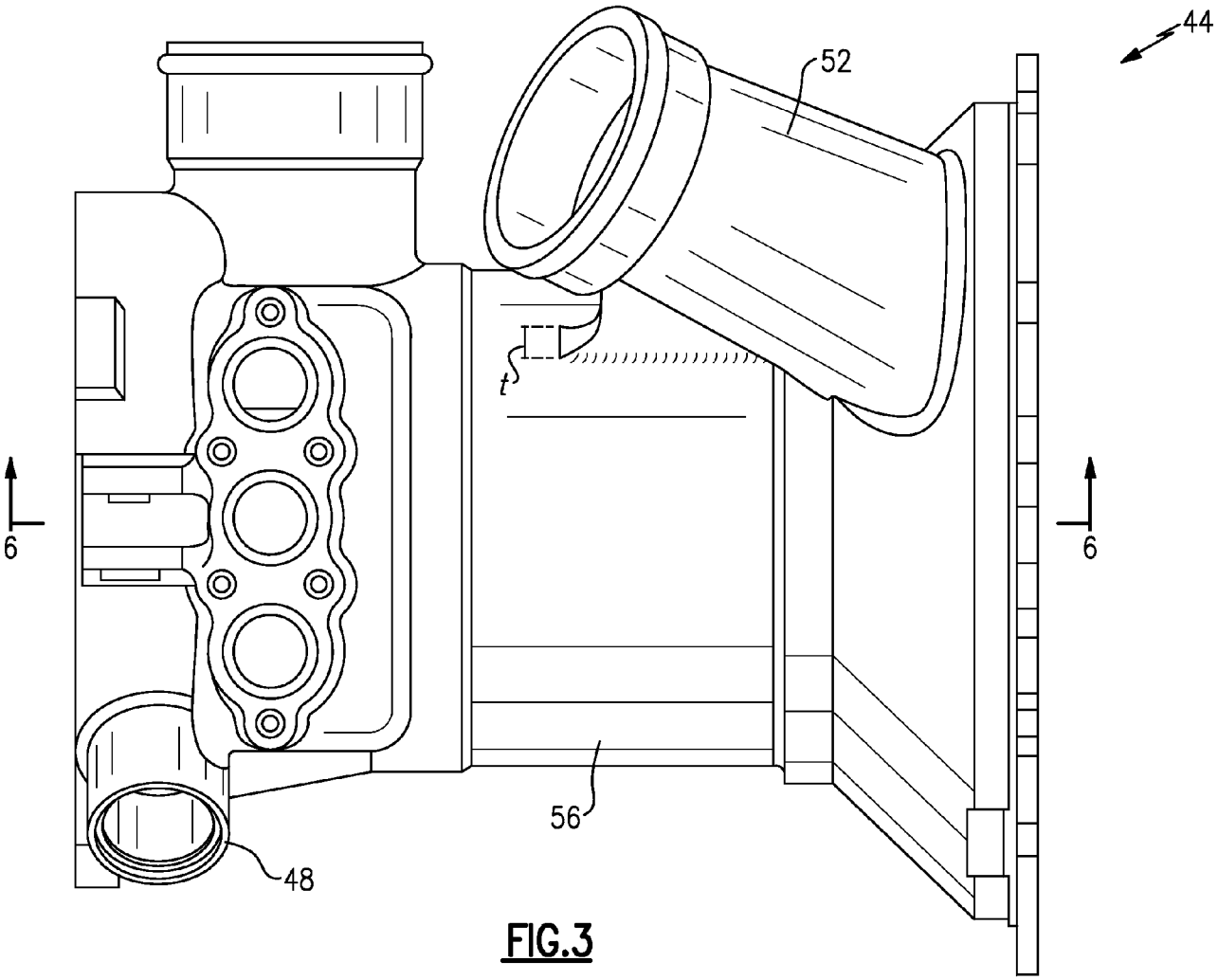
FIG. 3 shows a top view of the FIG. 2 housing.
Figure 4:
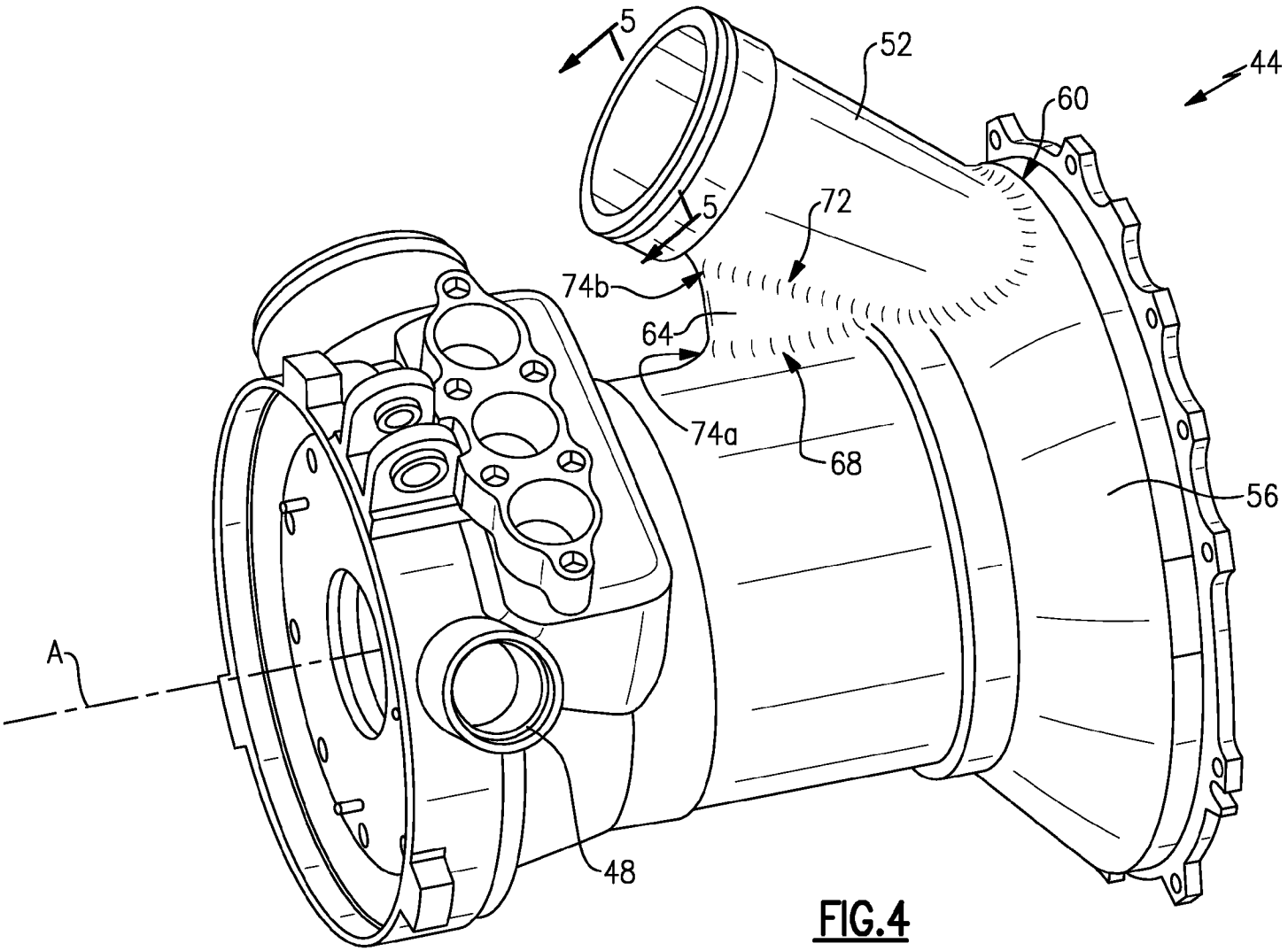
FIG. 4 shows another perspective view of the FIG. 2 housing.

Referring now to FIGS. 2-4 with continuing reference to FIG. 1, air is moved through the motor 36 to cool the motor 36 during operation. A housing 44 holds the motor 36 and at least a portion of the driveshaft 40. The air used to cool the motor 36 moves through a motor inlet duct 48 to the motor 36. The air moves from the motor 36 to a motor outlet duct 52.

In this example, the housing 44 is cast together as a single structure, which includes the motor inlet duct 48 and the motor outlet duct 52. In some specific examples, the housing 44 is an aluminum material that is investment cast. One example aluminum is C355.

Figure 5:
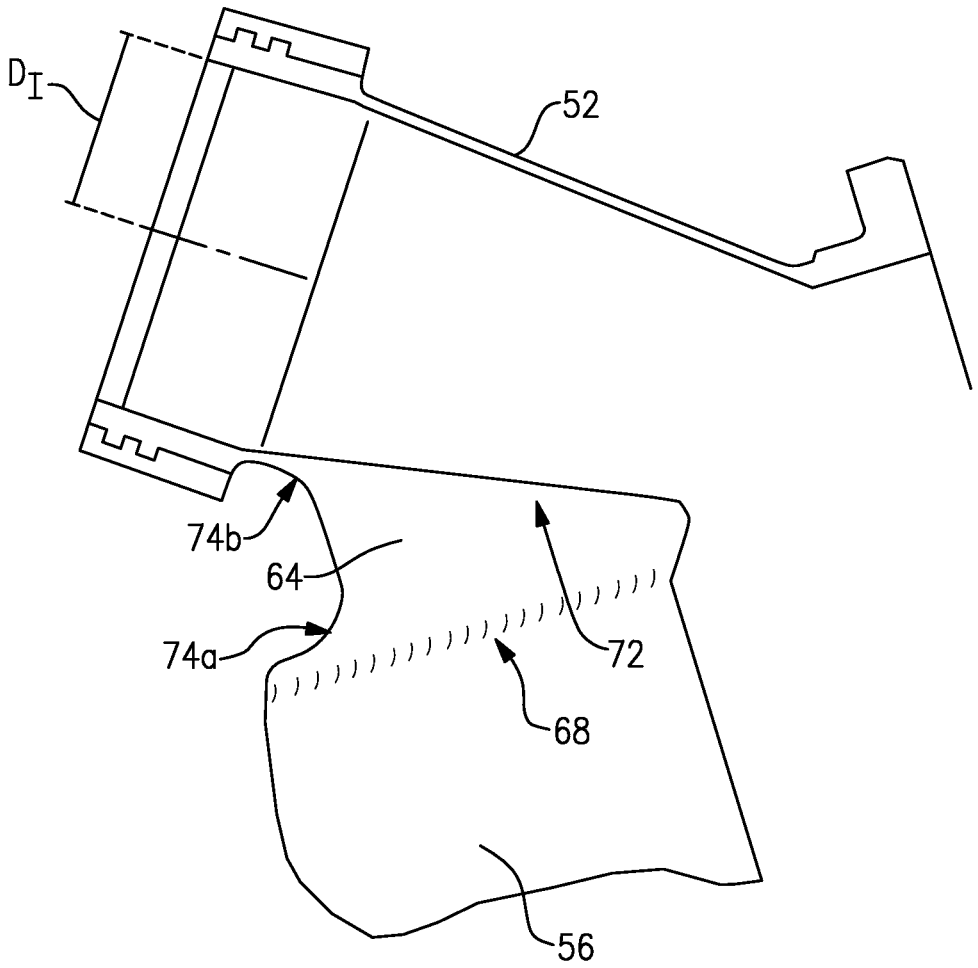
FIG. 5 shows a section view at line 5-5 in FIG. 4.
Figure 6:
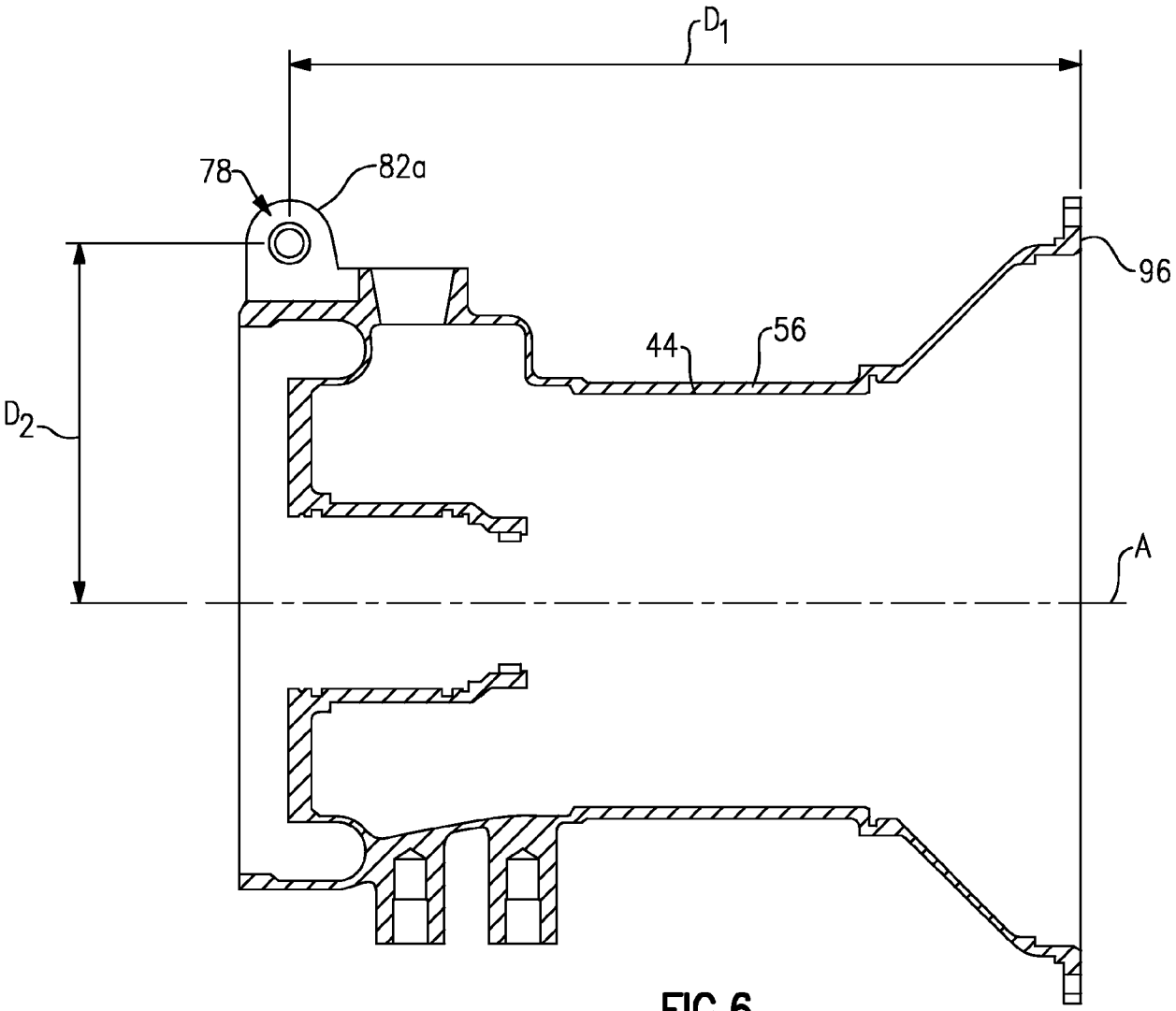
FIG. 6 shows a section view at line 6-6 in FIG. 3.
Figure 7:
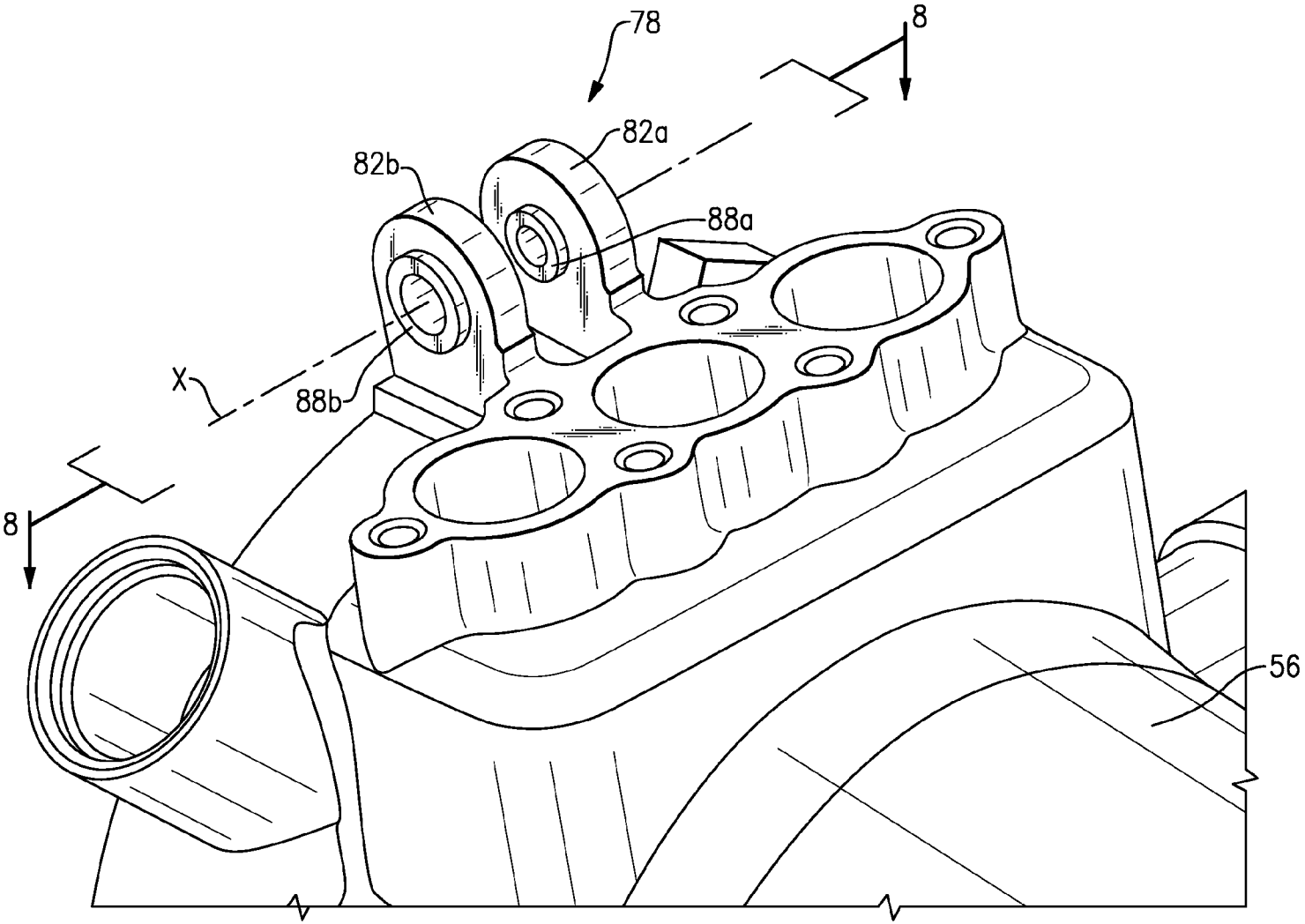
FIG. 7 shows a close-up view of a tie rod mount of the FIG. 2 housing.

Referring to FIG. 5 with continuing reference to FIGS. 1-4, the housing 44 includes a main body portion 56 that is generally cylindrical and disposed about an axis of rotation A of the motor 36 and driveshaft 40. The motor outlet duct 52 extends radially away from the main body portion 56. The motor outlet duct 52 is also angled backwards relative to the direction of flow through the main body portion 56, such that the motor outlet duct 52 extends upstream relative to a direction of flow through the main body portion 56.

The motor outlet duct 52 interfaces with the main body portion 56 at an interface area 60. The motor outlet duct 52 also interfaces with a flange 64. The flange 64 helps support the motor outlet duct 52. The flange 64 forms a portion of the housing 44. The flange 64 interfaces with the main body portion 56 at an interface area 68. The flange 64 interfaces with the motor outlet duct 52 at an interface area 72. The interface areas 72 and 68 extend generally in an axial direction.

At an end of the motor outlet duct 52 furthest from the main body portion 56, the motor outlet duct 52 has an inner radius $D_I$, which ranges from 1.365 to 1.405 inches (3.467 to 3.569 centimeters) in this example.

The interface areas 60, 68, and 72 are radiused fillets, which helps the housing 44 to withstand loads. The size of the fillets in the example interface areas 60, 68, and 72 is from 0.160 to 0.220 inches (0.406 to 0.559 centimeters).

In this example, the size of the radius in the interface areas 60, 68, and 72 has a specific relationship to the inner diameter inner radius $D_I$. Although the side of the radiuses within the interface areas 60, 68, and 72 may vary, a ratio of the fillet size to the inner radius $R_I$ is from 0.113 to 0.162. In another more specific example, the ratio of the fillet size to the inner radius $D_I$ ranges from 0.117 to 0.156 inches (0.297 to 0.396 centimeters).

Ratios falling within these ranges have been found to provide sufficient loading strength without adding unnecessary weight to the housing 44.

Other leading edge areas 74*a* and 74*b* are located at the leading edge of the flange 64 relative to the direction of flow through the main body portion 56. The leading edge area 74*a* transitions the main body portion 56 to the flange 64. The other leading edge area 74*b* transitions the flange 64 into the motor outer duct 52.

In this example, the size of the radius in the leading edge areas 74*a* and 74*b* has a specific relationship to a circumferential thickness T of the flange 64. The radius is from 0.470 to 0.530 inches (1.194 to 1.346 centimeters) and the circumferential thickness T is from 0.060 to 0.100 inches (0.152 to 0.254 centimeters). A ratio of the radius in the leading edge areas 74*a* and 74*b* to the circumferential thickness T is from 4.7 to 8.84. In another example, the range is from 5.300 to 7.833.

Referring now to FIGS. 6-9 with continuing reference to FIG. 1, the example air compressor 20 includes a tie rod mount 78. A tie rod (not shown) engages the tie rod mount 78 to secure the compressor within the aircraft. The tie rod mount 78 has flanges 82*a* and 82*b*. Each of the flanges 82*a* and 82*b* provides an aperture 86*a* and 86*b* that receives the tie rod. In this example, a bushing 88*a* and 88*b* is received within a respective one of the apertures 86*a* and 86*b*, and the bushings 88*a* and 88*b* directly interface with the tie rod.

Securing the cabin air compressor 20 using the tie rod and tie rod mount 78 facilitates rotating the cabin air compressor 20 during installation, maintenance, etc. The cabin air compressor 20 rotates about a rotational axis X, which, as can be appreciated, is a centerpoint of the apertures 86*a* and 86*b*, and a centerpoint of the bushings 88*a* and 88*b*.

The position of the axis X may be defined with reference to an end 96 of the housing 44 and with reference to the axis A of the cabin air compressor 20. The end 96 is the end of the housing 44 opposite the flanges 82*a* and 82*b*.

In this example, a distance $D_1$ is a distance from the axis X to an end 96 of the housing 44. The distance $D_1$ may be from 9.470 to 11.470 inches (24.054 to 29.13 centimeters).

In this example, a distance $D_2$ is a measurement of a distance from the axis X to the axis of rotation A. The distance $D_2$, in this example, is from 3.740 to 5.740 inches (9.500 to 14.580 centimeters). In this example, a ratio of the distance $D_1$ to the distance $D_2$ is from 1.65 to 3.07. In other examples, the ratio of the distance $D_1$ to the distance $D_2$ is from 1.99 to 2.53.

In this example, the diameter $D_3$ of the aperture 86*a* is from 0.375 to 0.376 inches (0.953 to 0.955 centimeters). A diameter $D_4$ of the aperture provided by the bushing 88*a* is from 0.250 to 0.251 inches (0.635 to 0.6375 centimeters). A diameter $D_5$ of the aperture 86*b* is from 0.5625 to 0.5635 inches (1.4288 to 1.4313 centimeters). A diameter $D_6$ of the aperture provided by the bushing 88*b* is from 0.4371 to 0.4381 inches (1.1102 to 1.1128 centimeters).

Thicknesses $T_a$ and $T_b$ of the flanges 82*a* and 82*b* are from 0.270 to 0.280 inches (0.6858 to 0.7112 centimeters).

In this example, a ratio of the diameters $D_5$ and $D_6$ of the apertures 86*a* and 86*b* to the thickness $T_b$ and $T_a$ of the flanges 82*a* and 82*b* is from 1.560 to 2.087.

Figure 8:
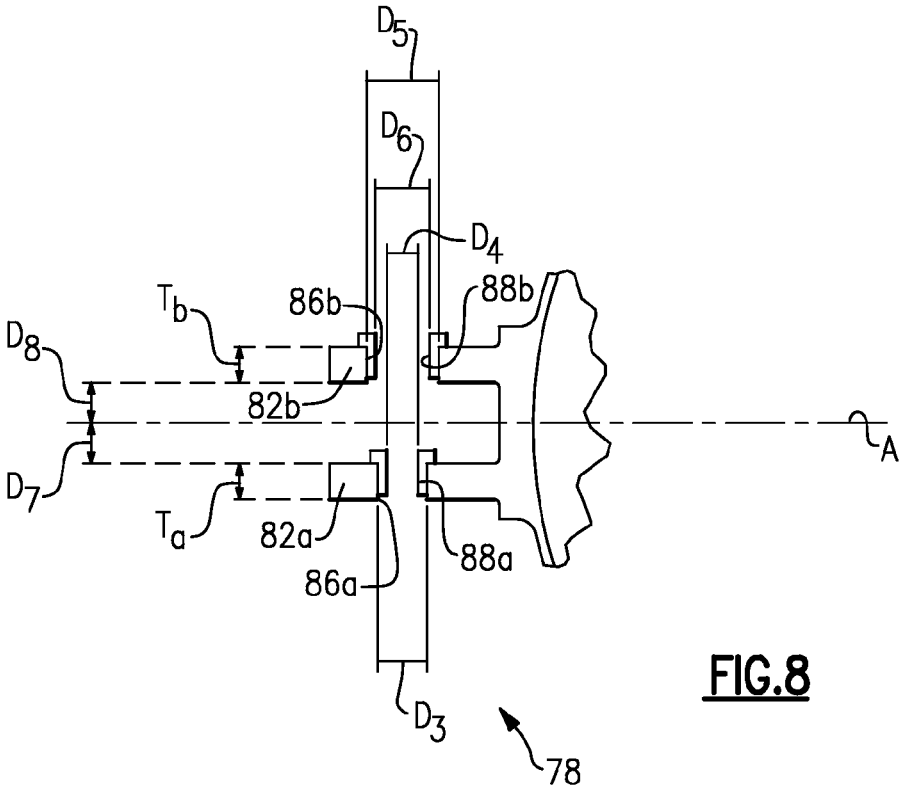
FIG. 8 shows a section view at line 8-8 in FIG. 7.

In this example, in the view of FIG. 8, the flange 82*a* is spaced a distance $D_7$ from the axis A, and the flange 82*b* is spaced a distance $D_8$ from the axis A. Distance $D_7$ is less than distance $D_8$. To accommodate specific mount isolator that fit into this area.

Figure 9:
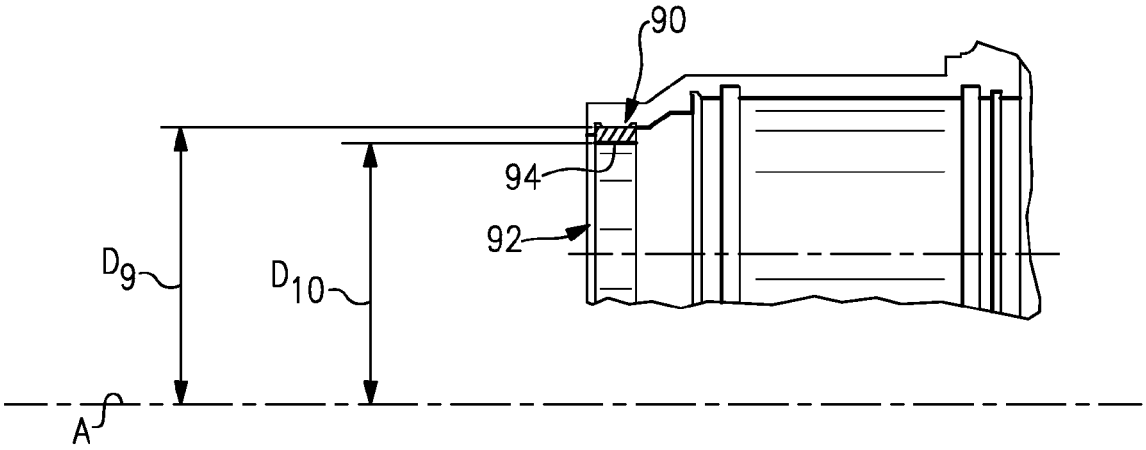
FIG. 9 shows a close-up view of a portion of the section of FIG. 6.

Referring to FIG. 9, a seal land 90 is provided within a bore 92 of the housing 44. A composite seal 94 is snapped into position within the seal land 90. During operation, some air may move between the seal 94 and the driveshaft 40 to cool bearings, for example.

The seal land 90 provided within the housing 44 a distance $D_9$, which is from 0.9135 to 0.9165 inches (2.32 to 2.328 centimeters) from the axis. The seal land 90 is machined into the housing 44 after the housing 44 has been cast.

An inwardly facing surface of the composite seal 94 is spaced a distance $D_{10}$ that is from 0.800 to 0.802 inches (2.032 to 2.037 centimeters) from the axis. The diameter $D_{10}$ is machined into the composite seal 94 after the seal 94 is positioned within the seal land 90. In this example, a ratio of the distance $D_9$ to the distance $D_{10}$ is from 1.139 to 1.145.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A housing of a compressor assembly comprising:
a main body portion;
a motor outlet duct extending radially from the main body portion; and
a flange extending radially from the main body portion to the motor outlet duct, wherein the motor outlet duct interfaces with the main body portion at an interface area, wherein a ratio of a radius of the interface area to an inner diameter of the motor outlet duct is from 0.113 to 0.162.

2. The housing of claim 1, wherein the main body portion is cylindrical.

3. The housing of claim 1, wherein the motor outlet duct is angled backwards relative to a direction of flow though the main body portion.

4. The housing of claim 1, wherein the inner radius is an inner radius at an end of the motor outlet duct furthest from the main body portion.

5. The housing of claim 1, wherein the ratio is from 0.117 to 0.156.

6. The housing of claim 1, wherein a ratio of a radius at a leading edge of the flange to a circumferential thickness of the flange is from 5.30 to 7.833.

7. The housing of claim 1, wherein the flange interfaces with the motor outer duct and the main body portion at other interface areas having the radius.

8. The housing of claim 1, further comprising at least one tie rod mounting flange providing an aperture configured to receive a tie rod, a centerpoint of the aperture is located a first distance from an end of the housing and a second distance from an a central axis of the housing, wherein a ratio of the first distance to the second distance is from 1.65 to 3.07.

9. The housing of claim 8, further comprising a seal land provided within a compressor housing, an inwardly facing surface of the seal land spaced a first distance from a rotational axis of the compressor; and
a seal that is received within the seal land, an inwardly facing surface of the seal land spaced a second distance from the rotational axis of the compressor, wherein a ratio of the first distance to the second distance is from 1.139 to 1.145.

10. The housing of claim 1, wherein the compressor assembly is a cabin air compressor assembly.

11. A housing of a compressor assembly comprising:
a housing; and
at least one tie rod mounting flange providing an aperture configured to receive a tie rod, a centerpoint of the aperture is located a first distance from an end of the housing and a second distance from a central axis of the housing, wherein a ratio of the first distance to the second distance is from 1.65 to 3.07.

12. The housing of claim 11, wherein the end of the housing is an end of the housing opposite the tie rod mounting flange.

13. The housing of claim 11, wherein the central axis is coaxial with a rotational axis of a motor held within the housing.

14. The housing of claim 11, wherein the ratio is from 1.99 to 2.53.

15. The housing of claim 11, wherein the at least one tie rod mounting flange comprises two flanges each providing an aperture, the apertures having a common centerpoint.

16. The housing of claim 11, wherein the compressor assembly is a cabin air compressor assembly.

17. The housing of claim 11, further comprising a flange extending radially from a main body portion of the housing to a motor outlet duct of the housing, wherein a ratio of a radius at a leading edge of the flange to a circumferential thickness of the flange is from 5.30 to 7.833.

18. A housing of a compressor assembly comprising:

a seal land provided within a compressor housing, an inwardly facing surface of the seal land spaced a first distance from a rotational axis of the compressor; and a seal that is received within the seal land, an inwardly facing surface of the seal land spaced a second distance from the rotational axis of the compressor, wherein a ratio of the first distance to the second distance is from 1.139 to 1.145.

19. The housing of claim 18, wherein the housing is configured to hold a motor of a cabin air compressor.

20. The housing of claim 18, further comprising an outlet duct flange extending radially from a main body portion of the compressor housing to a motor outlet duct of the compressor housing, wherein a ratio of a radius at a leading edge of the flange to a circumferential thickness of the flange is from 5.30 to 7.833.

* * * * *